United States Patent [19]

Bauerle

[11] 4,226,499

[45] Oct. 7, 1980

[54] ELECTRICAL CONTACT

[75] Inventor: Gerhard Bauerle, Willsbach, Fed. Rep. of Germany

[73] Assignee: Bunker Ramo Corporation, Oak Brook, Ill.

[21] Appl. No.: 915,331

[22] Filed: Jun. 13, 1978

Related U.S. Application Data

[60] Division of Ser. No. 789,954, Apr. 22, 1977, Pat. No. 4,109,993, which is a continuation of Ser. No. 675,329, Apr. 9, 1976, abandoned.

[30] Foreign Application Priority Data

Apr. 11, 1975 [DE] Fed. Rep. of Germany ..... 2515813

[51] Int. Cl.[3] ..... H01R 13/12

[52] U.S. Cl. ..... 339/258 R

[58] Field of Search ..... 339/258 R, 258 P, 176 MP

[56] References Cited

U.S. PATENT DOCUMENTS 2,882,512 4/1959 Morone, Jr. ..... 339/258 P

FOREIGN PATENT DOCUMENTS 1089838 9/1960 Fed. Rep. of Germany ... 339/176 MP
1309172 10/1962 France ..... 339/176 MP
157103 12/1956 Sweden ..... 339/217 S

*Primary Examiner*—Neil Abrams
*Attorney, Agent, or Firm*—F. M. Arbuckle; P. D. Ertel

[57] ABSTRACT

The present invention relates to a method of automatically assembling and mounting contacts in plug-type connectors with the plug-type connector consisting of a housing and a strip made of insulating material, which strip can be joined with the housing and which supports the contacts. In addition, the present invention relates to connectors produced according to the method.

11 Claims, 11 Drawing Figures

ELECTRICAL CONTACT

RELATED APPLICATION

This is a divisional application of application Ser. No. 789,954, filed Apr. 22, 1977, which issued on Aug. 29, 1978 as U.S. Pat. No. 4,109,993, on a continuation application of application Ser. No. 675,329, filed Apr. 9, 1976, now abandoned.

BACKGROUND OF THE INVENTION

The present invention relates to a method of automatically assembling and mounting contacts in plug-type connectors, with the plug-type connector consisting of a housing and a strip made of insulating material, which strip can be joined with the housing and which supports the contacts. In addition, the present invention relates to connectors produced according to the method.

Certain prior art plug-type connectors consist of an insulating strip accommodating individual contacts and of a housing into which the insulating strip is inserted. In both cases, the contacts have been embedded in the insulating strip in a heat treatment process, e.g., by thermoplastic coating or with an ultrasonic welding technique.

The heat treatment processes which can be used are relatively expensive and can be executed only with the aid of costly machinery, e.g., with automatic injection welding equipment. Moreover, when compared with the assembly of an insulating strip and contacts or the joining of the insulating strip with the housing, the heat treatment requires much time, so that there is the risk that half-finished products accumulate in the heat treatment station.

It is another disadvantage of the heat treatment method that the contacts are coated with a plastic film at least at contact sections protruding from the insulating strip, which means that the contacts must subsequently be cleaned.

The object of the subject invention is to provide a method for automatically mounting and assembling contacts in plug-type connectors, the new process being free of the disadvantages listed above. In particular, the proposed method makes it possible to achieve a high assembly rate without delay times in the operational production cycle. Furthermore, it is possible to execute the method of the subject invention with the aid of simple means so that adjustment and modification of contact strip length is simple and straightforward, thereby permitting the method to be employed in cases where plug-type connectors of different dimensions are used. Adapting the automatic injection molding apparatuses of known processes to different dimensions of plug-type connectors implies great expenditures.

SUMMARY OF THE INVENTION

According to the subject invention, the object of the invention is achieved by providing a web material as a band-like strip of insulating material into which the contacts are mechanically embedded. The housing is joined with the strip of insulating material, and sections of a desired length are separated from the band-like insulating strip only during the final assembly stage in which said insulating strip is joined with said housing.

The finished plug-type connector produced according to the method of the subject invention consists of an elongated housing member and a strip of insulating material joined with the housing. The strip is sufficiently long and has embedded therein individual contacts arranged in a predetermined spaced relationship. The contacts are inserted into the insulating strip, for example, by snapping the contacts into the strip. In final assembly, sections of the insulating strip of the desired length are separated from a continuous band-like webbing of the insulating material.

The advantage of using a band-like material as the initial material for the insulating strip is that, at the station at which the contacts are embedded into the insulating strip, the spacing is constant (the band material has not yet been cut open at the station), so that the contacts can be continuously inserted with a single machine which also forms the contacts. However, it is also possible to insert the contacts into the insulating strip at a later time. In this case, it is convenient to align the contacts with the aid of a vibrating device and to feed the contacts to the strip.

Furthermore, it is easier to handle a band-type material than short, separate insulating strips, because the band can be wound on a roll and unwound in the final assembly operation.

In contrast to prior art methods, the contacts are not embedded into the insulating strip by injection molding but, according to the method under consideration, the contacts are simply put into the insulating strip, which operation is more easily performed. Thus, the expensive, time-consuming heat treatment is unnecessary in the assembly of the plug-type connector according to the invention. Furthermore, the contacts need not be cleaned from the plastic film which develops in the course of heat treatment operations.

According to the proposed method, the insulating strips are cut to the desired lengths only after the assembly. Thus, it is easy to adapt the strips to housings of different lengths. It is therefore possible to use a single machine for assembling plug-type connectors of different dimensions without need for extensive modifications of the machine.

BRIEF DESCRIPTION OF THE DRAWING

The invention will now be described in detail with reference to the various figures of the drawings.

Figure 3:
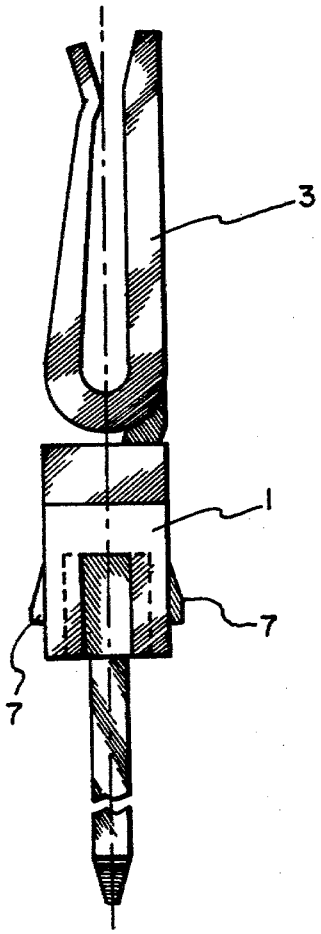
FIG. 3 is a lateral right end view of the insulating strip shown in FIGS. 1 and 2.
Figure 1:
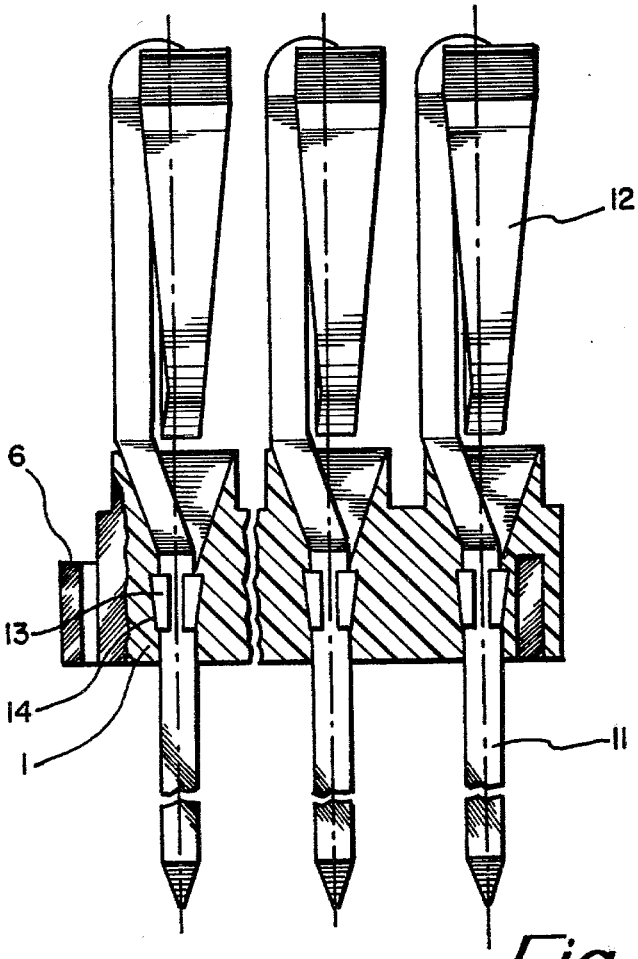
FIG. 1 is a cross section of a segment of the insulating strip according to the invention, with contacts inserted.
Figure 2:
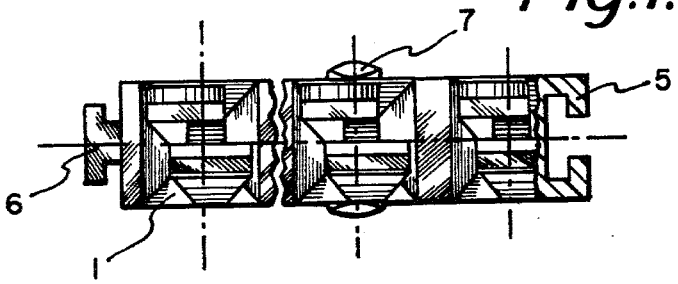
FIG. 2 is a top view of the insulating strip shown in FIG. 1.

The following description pertains to two embodiments of plug-type connectors as shown in FIGS. 1 through 8. The method of assembling the connector is described with reference to FIGS. 9 and 10.

DETAILED DESCRIPTION OF THE PREFERRED EMBODIMENTS

An assembled, finished connector consists of a strip 1 made of an insulating material into which either equidistant blade contacts 2 or equidistant spring contacts 3 have been inserted. Insulating strip 1, with blade contacts 2 or spring contacts 3 in place, is inserted into a locked-in position in housing 4. Contacts 2 and 3 are completely enclosed in housing 4 which is sealed with the insertion of insulating strip 1. FIGS. 1 through 4 refer to a strip of spring contacts, and FIGS. 5 through 8 refer to a strip of blade contacts. Other details will be described below.

In both embodiments (FIGS. 1 through 4 and FIGS. 5 through 8), the insulating strips 1 have been separated from the band, i.e., they have been divided into sections. The sections of insulating strip 1 were initially joined to form a single band. The junction was effected with mating elements 5 and 6 provided at the ends of each of the insulating strip.

Figure 7:
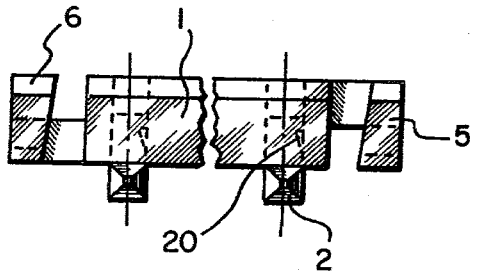
FIG. 7 is a top view of the insulating strip shown in FIGS. 5 and 6.
Figure 5:
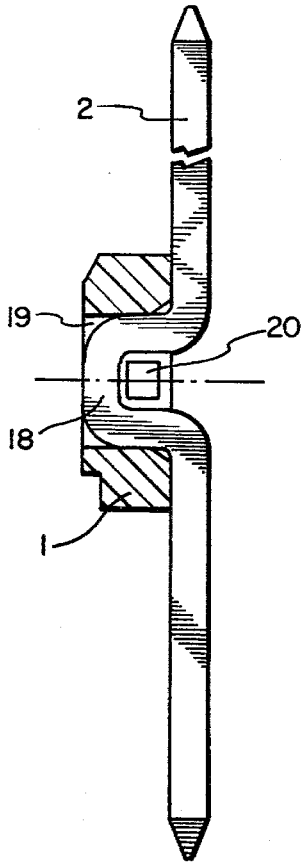
FIG. 5 is a cross section of another embodiment of an insulating strip with a blade-type contact inserted.
Figure 6:
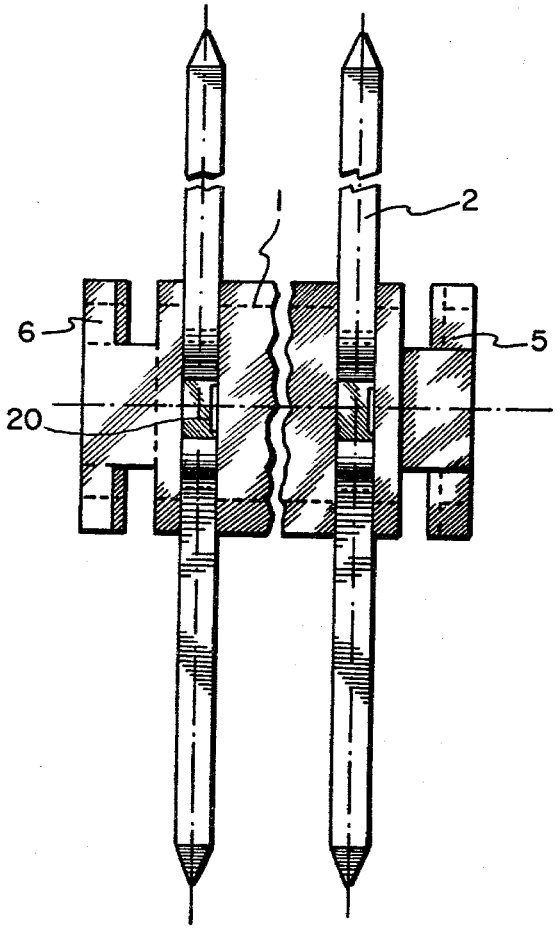
FIG. 6 is a front elevational view of the insulating strip shown in FIG. 5.

In the embodiments shown, the element 5 has the form of a pair of jaws providing a T-shaped recess in the end of strip 1. The other element 6 has the form of a T-shaped protrusion which fits into the jaws of element 5 of the adjacent section of insulating strip 1 of the initial band. As shown in FIGS. 6 and 7, the abutting edges of the mating elements may be beveled, so that interconnected sections of the insulating strip do not disengage under the influence of a tensile force; the elements remain firmly connected in this case.

However, mating elements 5 and 6 are only a preferred embodiment. The sections of the insulating strip can also be joined in some other manner. It is within the provisions of the invention to produce a continuous insulating strip, i.e., a strip without mating elements, and to cut the desired lengths from the strip or band.

Figure 4A:
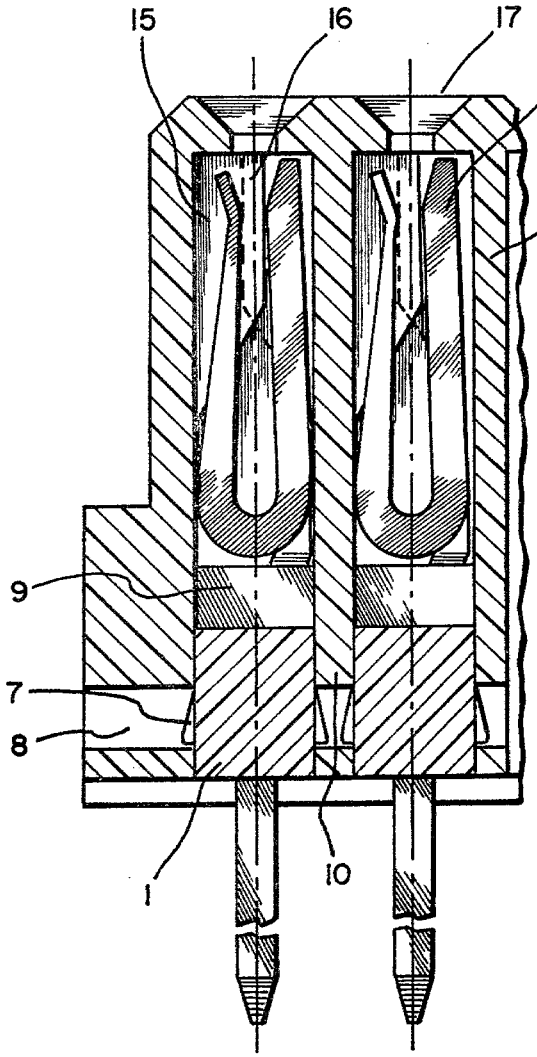
FIG. 4A is a partial lateral cross section of an assembled plug-type connector with spring-type contacts in plurality of parallel insulating strip inserted.
Figure 4B:
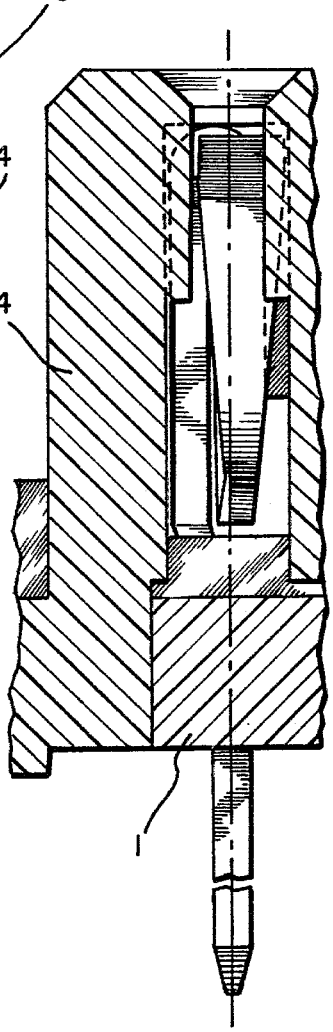
FIG. 4B is a partial longitudinal cross section of an assembled plug-type connector with spring-type contacts in an insulating strip inserted.
Figure 8:
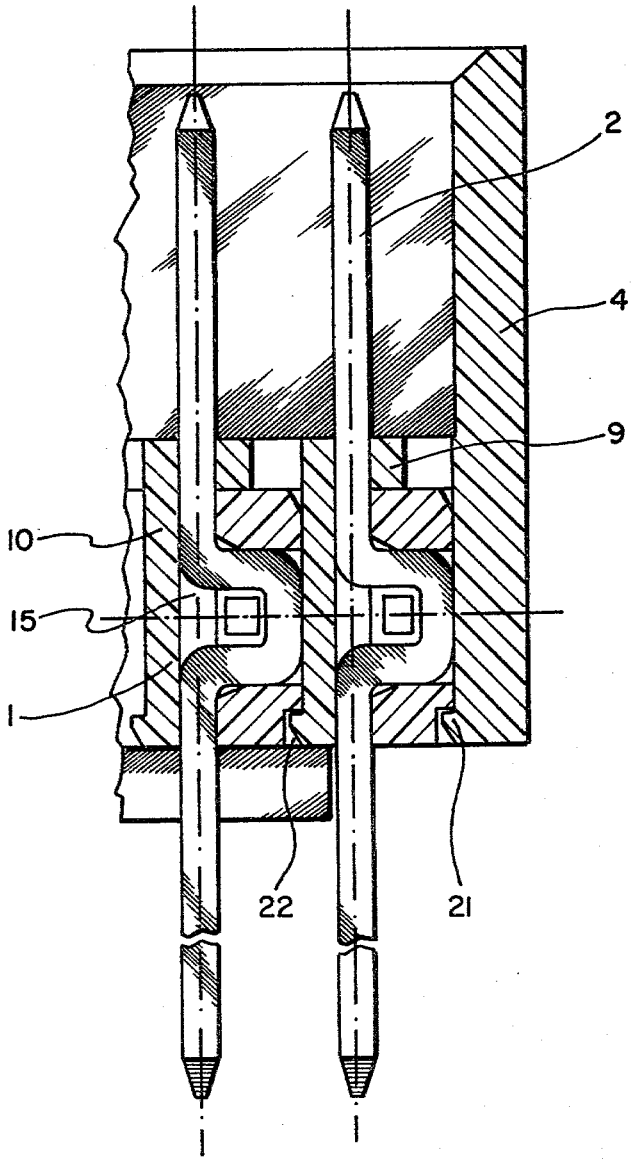
FIG. 8 is a partial lateral cross section of an assembled plug-type connector with blade-contacts in a plurality of parallel insulatin strips inserted.

Housing 4 is elongated and matingly accommodates an insulating strip 1 provided either with blade contacts 2 or with spring contacts 3. In the embodiments shown, housings 4 are formed so that they can accommodate several insulating strips 1 arranged in parallel relationship. As shown in FIGS. 4 and 8, the insulating strips 1 can be inserted into the bottom of housing 4 and locked into place. Locking tabs 7 which snap into mating recesses 8 in the housing are provided on insulating strip 1 to obtain an interlocking configuration. When the insulating strip 1 is inserted into housing 4 housing 4 is temporarily expanded. When a relatively rigid plastic material or some other insulating material is employed some other appropriate interlocking junction means can be selected.

When an insulating strip 1 is inserted into housing 4, the motion of insulating strip 1 is limited by stops 9 in housing 4 once the strip has reached its final position. Furthermore, parallel webs 10 are provided in housing 4. The webs separate the individual strips 1 inserted in housing 4 and align the strip sections.

The insulating strip of FIGS. 1 through 4 is provided with parallel bores into which spring contacts 3 have been inserted. The center section of each spring contact 3 is supported by insulating strip 1. Each spring contact 3 protrudes on one side in the form of a terminal post 11 and on the other side in the form of a spring member 12 from insulating strip 1. The center section of each spring contact 3 is provided with a collar 13 which fits into a mating recess 14 in insulating strip 1. When the collar 13 is sufficiently small (e.g., when only a bulge is provided in the material), a recess 14 need not be provided in the resilient strip 1. In this case the bulge can become locked into insulating strip 1 in an interference fit.

After inserting the spring contacts into insulating strip 1, the junctions serve to firmly support the insulating strips 1 for the ensuing assembly operations.

Housing 4, which is shown in FIG. 4 and used with the insulating strips 1, is provided with individual contact chambers 15 which are separated by the above-described webs 10.

The side walls of contact chambers 15 are provided with guiding members 16 used for the precise alignment and/or biasing of the spring contacts in contact chamber 15. In the embodiment shown in FIG. 4, the guiding members 16 are situated between the two tines of the fork-shaped spring contact 3.

On the side opposite to insulating strip 1, housing 4 has openings 17 issuing into a corresponding contact chamber 15 and into which a blade contact can be inserted.

Insulating strip 1 shown in FIGS. 5 through 8 is adapted to receive a blade contact 2. In this embodiment, the blade contact has been formed from wire and has a U-shaped section 18 in its center portion. Insulating strip 1 has a recess 19 of rectangular cross section into which the U-shaped section 18 of blade contact 2 fits. The walls of recess 19 of insulating strip 1 are provided with protrusions 20 which keep the blade contacts 2 inserted in strip 1 in a locked-in position. This interlocking engagement firmly keeps the blade contacts 2 in the insulating strip 2 so that the inserted blade contacts 2 cannot drop out of the insulating strip during assembly of the strips 1 with housing 4. In order to keep insulating strip 1 in a lock-in position in housing 4, the edges of the openings for insulating strip 1 are provided with beveled shoulders 21 which snap behind corresponding recesses 22 in insulating strip 1.

In this embodiment, as well as in the embodiment described above with reference to FIGS. 1 through 4, insulating strip 1 in housing 4 is prevented from moving by appropriately shaped stops 9.

In contrast to the embodiment shown in FIG. 4, the housing of FIG. 8 is completely open on the side farthest from insulating strip 1 so that a band of spring-type contacts of the form shown in FIG. 4 can be introduced.

The method of equipping the above-described insulating strip 1 with contacts 2, 3 and the assembly of the entire plug-type connectors will now be described in detail with reference to FIGS. 9 and 10 of the drawings.

Machine 25 includes a contact embossing tool 23.

Contacts 2, 3 are embossed and bent with tool 23 to obtain the desired blade contact 2 or spring contact 3 configuration. The contacts are produced from wire 24 arriving from a supply reel 28, after which the contacts are introduced into insulating strip 1 arriving from its supply reel 29. Thus, the insulating strips 1 with contacts 2 or 3 formed of wire are produced in a single operation in machine 25. Insulating strip 1 provided with the contacts is wound on a roll 26 on the output side of machine 25.

Figure 10:
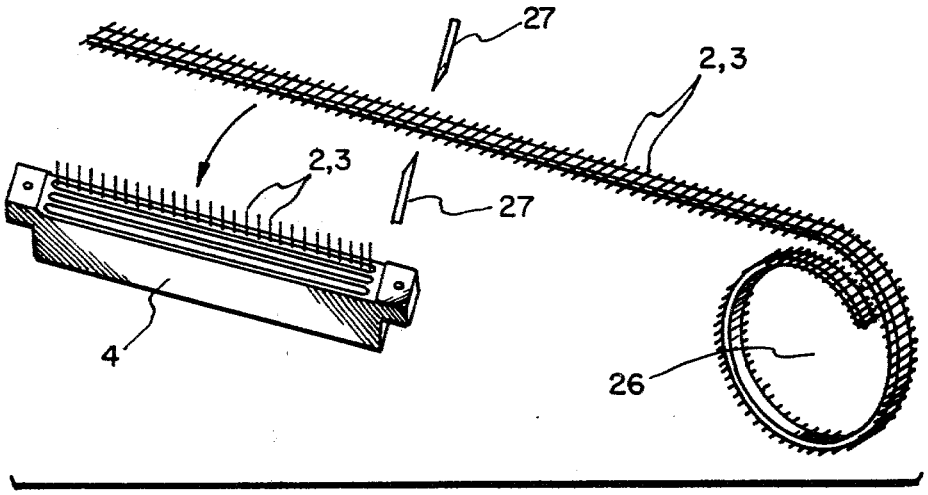

As shown in FIG. 10, roll 26 can be used in the final assembly operation. The strip length required for each plug-type connector is cut with cutters 27.

Figure 9:
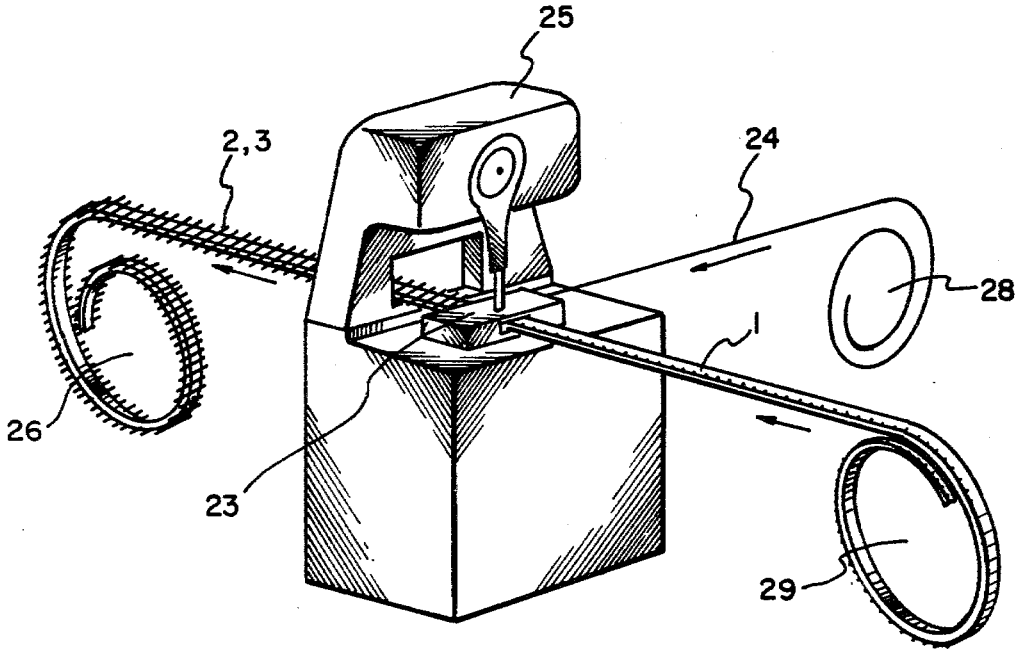
FIGS. 9 and 10 are schematic view of an assembly device for executing the method according to the invention.

The insulating strips equipped with contacts as shown in FIG. 9 and wound on roll 26 can undergo an electroplating treatment even while they are wound on the roll.

If desired, insulating strip 1 need not be equipped with the contacts while contacts 2 and 3 are formed on machine 25. It is possible to feed the contacts with the aid of vibrating devices to insulating strip 1 on a separate machine.

The embodiments of the invention in which an exclusive property or privilege is claimed are defined as follows:

1. An electrical contact comprising:

a terminal post at one end;

a spring contact at the other end; and an intermediate contact segment joining said terminal post and said spring contact;

said spring contact including a first contact portion extending from said intermediate contact segment substantially parallel to said terminal post, a first return bend portion, a second contact portion extending from said first return bend portion substantially parallel to said first contact portion, a second return bend portion, a third contact portion extending from said second return bend portion substantially parallel to said second contact portion, said first and second contact portions defining a plane disposed at an angle to a second, distinct plane defined by said second and third contact portions, said second and third contact portions defining a contact receiving spring member located substantially in line with said terminal post.

2. The electrical contact of claim 1 wherein said third contact portion is bent away from said second contact portion at the end thereof remote from said second return bend portion to provide a guide for directing a mating contact into said spring member.

3. The electrical contact of claim 1 wherein said first and second contact portions define a plane disposed at an angle of 90° to said second, distinct plane defined by said second and third contact portions, said first return bend portion being disposed in said plane defined by said first and second contact portions and said second return bend portion being disposed in said plane defined by said second and third contact portions.

4. The electrical contact of claim 1 wherein said terminal post has a longitudinal axis, said intermediate contact segment extending from said terminal post to a point spaced from said longitudinal axis, said first contact portion extending substantially parallel to said longitudinal axis, and said spring member being disposed along said longitudinal axes and in spaced relationship to said terminal post.

5. The electrical contact of claim 1 wherein said contact is formed from square electrically conductive material.

6. The electrical contact of claim 1 wherein said first contact portion joins said spring member to said intermediate contact segment.

7. The electrical contact of claim 6 wherein said first contact portion is integral with said spring member remote from said intermediate contact segment.

8. The electrical contact of claim 7 wherein said first contact portion is integral with said intermediate contact segment adjacent said spring member.

9. The electrical contact of claim 1 wherein said spring member includes a guide portion for directing a mating contact into said spring member.

10. The electrical contact of claim 9 wherein said guide portion is located at the end of said spring member remote from said terminal post.

11. The electrical contact of claim 10 wherein said spring member includes a contact receiving portion for making electrical connection with said mating contact.

* * * * *